US009988879B2

(12) United States Patent
Prestwood et al.

(10) Patent No.: US 9,988,879 B2
(45) Date of Patent: Jun. 5, 2018

(54) ZONAL ALLOCATION FOR MULTILAYERED SUBTERRANEAN RESERVOIRS

(71) Applicant: Chevron U.S.A. Inc., San Ramon, CA (US)

(72) Inventors: Irina Prestwood, Houston, TX (US); Pojana Vimolsubsin, Houston, TX (US); Pavarit Trakulhoon, Houston, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 1017 days.

(21) Appl. No.: 14/225,166

(22) Filed: Mar. 25, 2014

(65) Prior Publication Data

US 2014/0288909 A1 Sep. 25, 2014

Related U.S. Application Data

(60) Provisional application No. 61/805,135, filed on Mar. 25, 2013.

(51) Int. Cl.
*E21B 41/00* (2006.01)
*E21B 43/14* (2006.01)

(52) U.S. Cl.
CPC ..... *E21B 41/00* (2013.01); *E21B 43/14* (2013.01)

(58) Field of Classification Search
CPC ..... E21B 41/00; E21B 43/14
USPC ..... 703/9, 10
See application file for complete search history.

(56) References Cited

U.S. PATENT DOCUMENTS

2008/0128128 A1* 6/2008 Vail ..... E21B 43/128 166/250.15
2010/0300682 A1* 12/2010 Thakur ..... E21B 43/16 166/250.01

OTHER PUBLICATIONS

BCOGC (Summary Information: Cummingled Production, 2011 (4 pages)).*

* cited by examiner

*Primary Examiner* — Andre Pierre Louis

(57) ABSTRACT

A system, method, and software are provided for use in modeling zonal allocation in multilayered subterranean reservoirs. Information associated with a wellbore that is in fluid communication with producing zones of a multilayered subterranean reservoir is provided. A methodology is selected to compute zonal splits for the wellbore and zonal splits for the wellbore are automatically computed using the selected methodology and the information associated with the wellbore.

19 Claims, 13 Drawing Sheets

400

480

EXISTING ZONAL SPLITS SUMMARY | COMPUTE ZONAL SPLITS

| WELL CODE | RESERVOIR CODE | ZONE CODE | EXISTING ZONAL SPLITS AT A RESERVOIR LEVEL FROM A DATABASE | | | EXISTING RESERVOIR SPLITS AT A RESERVOIR LEVEL FROM A SYSTEM OF RECORDS | | | EXISTING ZONAL SPLITS FROM A DATABASE | | | EXISTING ZONAL SPLITS FROM A SYSTEM OF RECORDS | | |
|---|---|---|---|---|---|---|---|---|---|---|---|---|---|---|
| | | | GAS | OIL | WATER | GAS | OIL | WATER | GAS | OIL | WATER | GAS | OIL | WATER |
| EFFECTIVE DATE: JULY 20, 2009 (TWO ITEMS) | | | | | | | | | | | | | | |
| WELL-A | RESERVOIR-A | ZONE-A | 1.00 | 1.00 | 1.00 | | | | 1.00 | 1.00 | 1.00 | | | |
| WELL-A | RESERVOIR-B | ZONE-B | 0.00 | 0.00 | 0.00 | | | | 0.00 | 0.00 | 0.00 | | | |
| EFFECTIVE DATE: JUNE 6, 2009 (ELEVEN ITEMS) | | | | | | | | | | | | | | |
| WELL-A | RESERVOIR-A | ZONE-C | | | | | | | 0.17 | 0.17 | 0.17 | | | |
| WELL-A | RESERVOIR-A | ZONE-A | | | | | | | 0.35 | 0.35 | 0.35 | | | |
| WELL-A | RESERVOIR-A | ZONE-D | | | | | | | 0.00 | 0.00 | 0.00 | | | |
| WELL-A | RESERVOIR-A | ZONE-E | | | | | | | 0.00 | 0.00 | 0.00 | | | |
| WELL-A | RESERVOIR-A | ZONE-F | | | | | | | 0.00 | 0.00 | 0.00 | | | |
| WELL-A | RESERVOIR-A | ZONE-G | 1.00 | 1.00 | 1.00 | | | | 0.10 | 0.10 | 0.10 | | | |
| WELL-A | RESERVOIR-A | ZONE-H | | | | | | | 0.18 | 0.18 | 0.18 | | | |
| WELL-A | RESERVOIR-A | ZONE-I | | | | | | | 0.12 | 0.12 | 0.12 | | | |
| WELL-A | RESERVOIR-A | ZONE-J | | | | | | | 0.00 | 0.00 | 0.00 | | | |
| WELL-A | RESERVOIR-A | ZONE-K | | | | | | | 0.05 | 0.05 | 0.05 | | | |
| WELL-A | RESERVOIR-A | ZONE-L | | | | | | | 0.03 | 0.03 | 0.03 | | | |

405 410 415 420 425 430 435 440 445 450

FIG. 4A

400

EXISTING ZONAL SPLITS SUMMARY (CONT'D)

| SUBMISSION STATUS | SELECTED METHODOLOGY | COMMENTS | OTHER DATA |
|---|---|---|---|
| EFFECTIVE DATE: JULY 20, 2009 (TWO ITEMS) | | | |
| SUBMITTED FOR APPROVAL | PHI*H SPLIT | | |
| SUBMITTED FOR APPROVAL | PHI*H SPLIT | | |
| EFFECTIVE DATE: JUNE 6, 2009 (ELEVEN ITEMS) | | | |
| SUBMITTED FOR APPROVAL | PHI*H SPLIT | | |
| SUBMITTED FOR APPROVAL | PHI*H SPLIT | | |
| SUBMITTED FOR APPROVAL | PHI*H SPLIT | | |
| SUBMITTED FOR APPROVAL | PHI*H SPLIT | | |
| SUBMITTED FOR APPROVAL | PHI*H SPLIT | | |
| SUBMITTED FOR APPROVAL | PHI*H SPLIT | | |
| SUBMITTED FOR APPROVAL | PHI*H SPLIT | | |
| SUBMITTED FOR APPROVAL | PHI*H SPLIT | | |
| SUBMITTED FOR APPROVAL | PHI*H SPLIT | | |
| SUBMITTED FOR APPROVAL | PHI*H SPLIT | | |

455 460 465 470 470 475

FIG. 4B

600

601

COMPUTE ZONAL SPLITS | 605 SELECT WELL | 610 SELECT DATE | 615 SELECT METHODOLOGY | COMPUTE HISTORICAL

| WELL CODE | RESERVOIR CODE | ZONE CODE | DATE | ZONE STATUS | KCORR*H OIL SPLIT | KCORR*H GAS SPLIT | KCORR*H WATER SPLIT | PHI*H OIL SPLIT | PHI*H GAS SPLIT | PHI*H WATER SPLIT |
|---|---|---|---|---|---|---|---|---|---|---|
| WELL-A | RESERVOIR-A | ZONE-M | 1/4/13 | OPEN | .36 | .36 | .36 | .34 | .34 | .34 |
| WELL-A | RESERVOIR-A | ZONE-N | 1/4/13 | OPEN | .24 | .24 | .24 | .22 | .22 | .22 |
| WELL-A | RESERVOIR-A | ZONE-O | 1/4/13 | OPEN | .20 | .20 | .20 | .13 | .13 | .13 |
| WELL-A | RESERVOIR-A | ZONE-P | 1/4/13 | OPEN | .09 | .09 | .09 | .21 | .21 | .21 |
| WELL-A | RESERVOIR-A | ZONE-Q | 1/4/13 | OPEN | .11 | .11 | .11 | .10 | .10 | .10 |

680 685 690 665 670 675

FIG.6A

600

COMPUTE ZONAL SPLITS (CONT'D)

| SPLITCOOIL | SPLITCOGAS | OTHER METHODOLOGY (E.G., PLT OR ILT) |
|---|---|---|
| .01 | .17 | |
| .60 | .50 | |
| .09 | .02 | |
| .03 | .05 | |
| .27 | .26 | |

655 660 695

FIG.6B

700

```
FOil=if(NetPayOil>0,1,0);

FGas=if(NetPayGas>0,1,0);

GOR=600;

CGRInv=20000;

ProducingGOR=1000;

Phi_h_FOil=NetPayOil*Phi*FOil;

Phi_h_FGas=NetPayGas*Phi*FGas;

FractionCond=IF(sum(Phi_h_Foil)=0,1,IF( (ProducingGOR<GOR) | (Sum(Phi_h_FGas)=0) , 0,
IF( (ProducingGOR>CGRInv), 1, ( (ProducingGOR-GOR)/CGRInv)/(1-(GOR/CGRInv) )  ) ) );

FractionSolGas = IF(sum(Phi_h_FGas)=0,1, if( (ProducingGOR>CGRInv) | (sum(Phi_h_FOil)=0),
0, IF(ProducingGOR<GOR,1, (1/ProducingGOR)-(1/CGRInv) )* (GOR/(1-(GOR/CGRInv) ) ) ) );

SplitCoOil = if(sum(Phi_h_Foil)=0, 0, Phi_h_Foil / sum(Phi_h_Foil) * (1-FractionCond) ) +
if(sum(Phi_h_FGas)=0,0,Phi_h_FGas/sum(Phi_h_FGas)*FractionCond);

SplitCoGas = if(sum(Phi_h_FGas)=0,0, Phi_h_FGas / sum(Phi_h_FGas) * (1-FractionSolGas) ) +
if(sum(Phi_h_FOil)=0,0,Phi_h_FOil /sum(Phi_h_FOil)*FractionSolGas);
```

FIG.7A

705

METHODOLOGIES/COLUMNS

Zone Status
H
Phi
K
Swi
Zone/Sand Class. Code
GOR
Zone/Sand Class. Desc
1/CGR
Producing GOR
Hgas
PLT Oil Factor
PLT Gas Factor
Hoil
PLT Water Factor
K*H
Phi*H
K*HSplit
Kcorr*H Oil Split
Kcorr*H Gas Split
Kcorr*H Water Split
Phi*H Oil Split
Phi*H Gas Split
Phi*H Water Split
PLT Gas Split
PLT Oil Split
PLT Water Split
CondensateFraction
SolutionGasFraction
Final Gas SF
Final Oil SF
Final Water SF
Kcorr
Kcorr*H
Comm Phi*Hgas
Comm Phi*Hoil
Comm Gas Split
Comm Oil Split

FIG. 7B

900

HISTORICAL ZONAL SPLITS

| WELL CODE | RESERVOIR CODE | ZONE CODE | GAS | OIL | WATER | OTHER DATA |
|---|---|---|---|---|---|---|
| ZONE START DATE: JULY 20, 2009 (TWO ITEMS) | | | | | | |
| WELL-A | RESERVOIR-A | ZONE-A | | | | |
| WELL-A | RESERVOIR-B | ZONE-B | | | | |
| ZONE DATE: MAY 20, 2007 (ELEVEN ITEMS) | | | | | | |
| WELL-A | RESERVOIR-A | ZONE-C | | | | |
| WELL-A | RESERVOIR-A | ZONE-A | | | | |
| WELL-A | RESERVOIR-A | ZONE-D | | | | |
| WELL-A | RESERVOIR-A | ZONE-E | | | | |
| WELL-A | RESERVOIR-A | ZONE-F | | | | |
| WELL-A | RESERVOIR-A | ZONE-G | | | | |
| WELL-A | RESERVOIR-A | ZONE-H | | | | |
| WELL-A | RESERVOIR-A | ZONE-I | | | | |
| WELL-A | RESERVOIR-A | ZONE-J | | | | |
| WELL-A | RESERVOIR-A | ZONE-K | | | | |
| WELL-A | RESERVOIR-A | ZONE-L | | | | |
| ZONE START DATE: OCTOBER 15, 2004 (NINE ITEMS) | | | | | | |
| ZONE START DATE: OCTOBER 14, 2004 (SEVEN ITEMS) | | | | | | |
| ZONE START DATE: OCTOBER 13, 2004 (EIGHT ITEMS) | | | | | | |
| ZONE START DATE: DECEMBER 22, 2003 (SEVEN ITEMS) | | | | | | |

FIG. 9

ZONAL ALLOCATION FOR MULTILAYERED SUBTERRANEAN RESERVOIRS

CROSS-REFERENCE TO RELATED APPLICATIONS

The present application claims priority from U.S. Provisional Application No. 61/805,135, filed on Mar. 25, 2013, the disclosure of which is hereby incorporated by reference in its entirety.

TECHNICAL FIELD

The present disclosure relates generally to modeling fluids in subterranean reservoirs, and more particularly to a system, method, and computer program product for use in modeling zonal allocation in multilayered subterranean reservoirs.

BACKGROUND

In multilayered subterranean reservoirs, well flow profiles, zonal productivities and zonal splits (i.e., fractions of oil, water, or gas) can be determined and used to allocate fluid production and injection rates. For example, production or injection logging tools (PLTs or ILTs, respectively) can be used to measure fluid flow contributions at each reservoir interval or completion interval. Analysis of the PLT data for a production well provides detailed information on which reservoir layers (also referred to as zones) are producing and what type of fluid (e.g., oil, water, gas) is being produced. Similarly, ILT data for an injection well can provide injectivity profiles for the well (i.e., the proportion of injected fluid entering each layer or set of perforations). The PLT/ILT data can be used to update reservoir models and ensure that simulation results match production and injection data. Moreover, zonal productivity and zonal splits information can be used to optimize placement of infill wells by targeting specific zones or used to identify candidates for production optimization (e.g., well intervention, additional perforations, re-perforating, zonal shut-offs) by diagnosing problems in well injectivity or productivity.

Numerous methodologies have been utilized to compute zonal injectivity/productivity and zonal splits. These methodologies often vary depending on quality and availability of data (e.g., PLT/ILT, permeability, porosity), and are currently performed manually. For example, such methodologies typically require engineers/operators to manually examine log and test data to determine the fraction of production from well zones based on various correlations, PLT/ILT data, and static reservoir/zonal data calculations. After fractions are determined, they are applied to split well injection and production to the appropriate layers. Each instance that zonal injectivity/productivity and zonal splits are computed, the engineers/operators typically consider what layers are currently open, what well equipment (e.g., sliding side-door (SSD), water injection mandrel (WIM)) is installed down hole, the reservoir properties of each layer, and when the last PLT/ILT profile was run. This interpretation process (e.g., determining what data is useful) and manually inputting this data into the model is often tedious and very time consuming. Furthermore, because the above methodologies are performed manually, the importance of the certain intricacies can be occasionally surrendered as aspects are overlooked or simply undervalued.

SUMMARY

A system, method, and software are provided for use in modeling zonal allocation in multilayered subterranean reservoirs. Information associated with a wellbore that is in fluid communication with producing zones of a multilayered subterranean reservoir is provided. A methodology is selected to compute zonal splits for the wellbore and zonal splits for the wellbore are automatically computed using the selected methodology and the information associated with the wellbore.

BRIEF DESCRIPTION OF THE DRAWINGS

FIGS. 4A-4B illustrate an exemplary screenshot of a zonal allocation modeling tool used for visualizing existing zonal splits.

FIGS. 6A-6B illustrate another exemplary screenshot of a zonal allocation modeling tool used for computing zonal splits, which can be used in modeling zonal allocation in multilayered subterranean reservoirs.

FIG. 7A illustrates at least one exemplary commingling methodology for computing zonal splits.

FIG. 7B illustrates a plurality of exemplary methodologies for computing zonal splits.

FIG. 9 illustrates an exemplary screenshot of a zonal allocation modeling tool used to provide historical zonal splits.

DETAILED DESCRIPTION

Embodiments of the present disclosure relate to a zonal allocation modeling tool that can be used to allocate production and injection volumes to subsurface layers of a reservoir. As will be described, the zonal allocation modeling tool uses available reservoir properties, tests, logs, well completion data, etc. to generate zonal splits using one or more methodologies that can be selected by a user (e.g., an operator/engineer). The zonal allocation modeling tool provides a library of methodologies to compute zonal splits, and the library of methodologies to compute zonal splits can be extended by the user. The zonal allocation modeling tool allows the user to examine available methodologies (e.g., perform "what if scenarios"), choose the appropriate methodology, automatically populate it into the production system and run zonal allocation; thereby, providing almost instantaneous production volumes per layer for each well in question. Additionally, the tool is also capable of moving through well history (e.g., well logs, well intervention records) and compiling a full set of splits for the entire life of the well. The zonal allocation modeling tool also stores the allocated production and injection volumes in a database for reporting and analysis purposes. Accordingly, the zonal allocation modeling tool may result in significant time savings and may provide information (e.g., set of splits for the entire lifetime of the well) that was previously not available.

In embodiments, the zonal allocation modeling tool generates zonal splits in an automated fashion. The terms "automatic" and "automated" denote functions and processes that can be conducted using tools and mechanisms, directed by a computing device, with minimal to no human effort to accomplish. For example, in existing systems, engineers/operators manually examine historical data to determine the fraction of production from well zones and manually input this data into the model. The automated approach discussed herein allows for the zonal allocation modeling tool to automatically generate zonal splits, thereby eliminating the need for the engineer/operator to manually calculate zonal split information and populate the model with this information, thereby allowing for simpler (and less time-intensive) determination of zonal splits.

Figure 1:
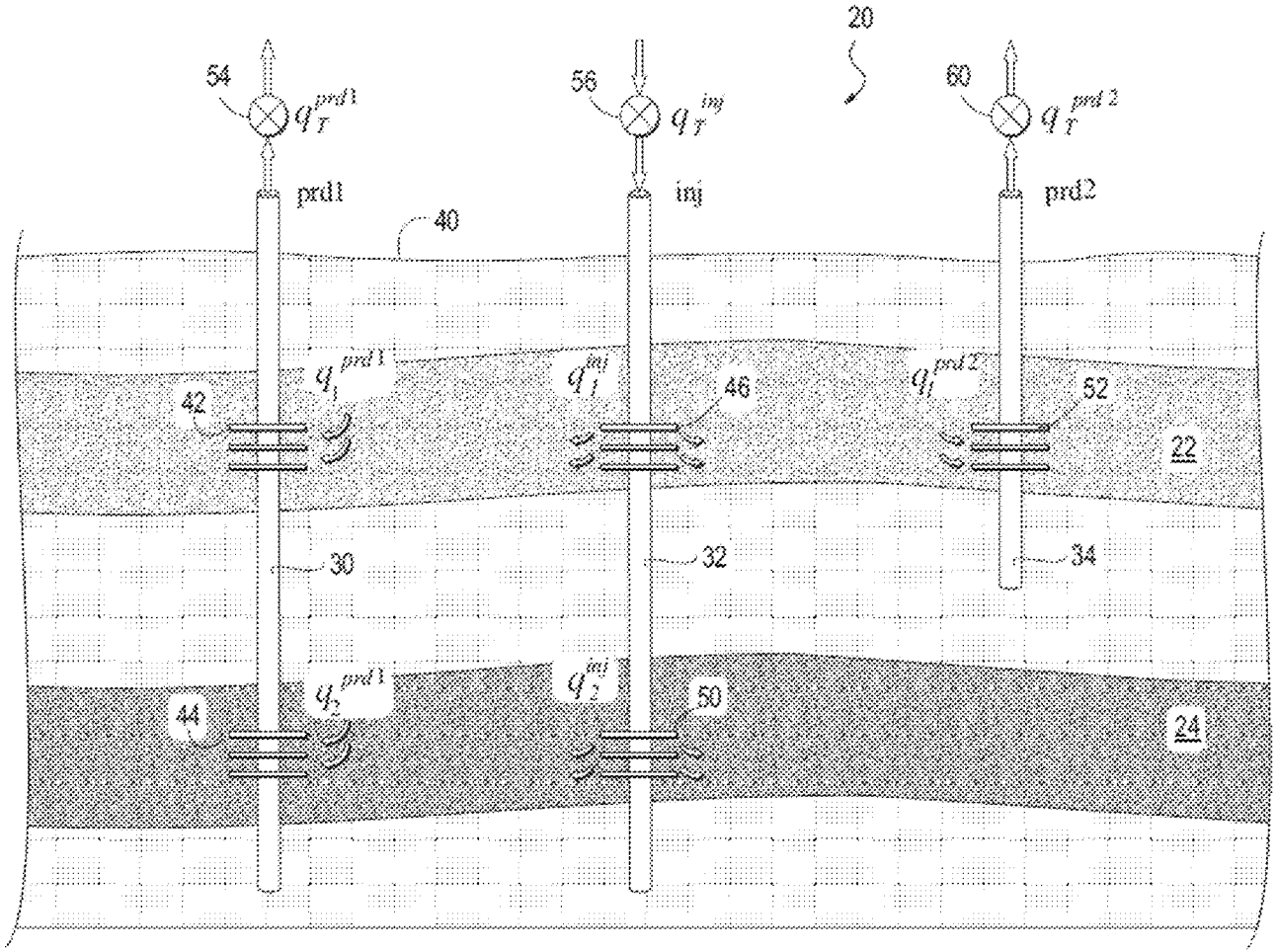
FIG. 1 schematically illustrates an exemplary multilayered subterranean reservoir.

FIG. 1 schematically illustrates an exemplary multilayered subterranean reservoir 20. Subterranean reservoir 20 can be any type of subsurface formation in which hydrocarbons are stored, such as limestone, dolomite, oil shale, sandstone, or a combination thereof. As illustrated in FIG. 1, production wells 30, 34 and injection well 32 are drilled and completed in subterranean reservoir 20. Production or injection wells can deviate from the vertical position such that in some embodiments, one or more wells can be a directional well, horizontal well, or a multilateral well. In embodiments, fewer or additional injection wells and/or production wells can also extend into hydrocarbon bearing zones 22, 24 of subterranean reservoir 20. Subterranean reservoir 20 includes a plurality of rock layers including hydrocarbon bearing strata or zones 22, 24. In embodiments, the subterranean reservoir 20 may include more zones than those illustrated in FIG. 1. Production wells 30, 34 and injection well 32 extend into one or more of the plurality of rock layers (e.g., hydrocarbon bearing strata or zones 22, 24) of subterranean reservoir 20 such that the production wells 30, 34 and injection well 32 are in fluid communication with hydrocarbon bearing zones 22, 24. For example, production wells 30, 34 can receive fluids (e.g., gas, oil, water) from hydrocarbon bearing zones 22, 24 and injection well 32 can inject fluid into hydrocarbon bearing zones 22, 24. Accordingly, production wells 30, 34 and injection well 32 fluidly connect hydrocarbon bearing zones 22, 24 to surface 40 of subterranean reservoir 20. Surface 40 of subterranean reservoir 20 can be a ground surface as depicted in FIG. 1 or a platform surface in an offshore environment.

As one skilled in the art will recognize, production or injection wells can be completed in any manner (e.g., an openhole completion, a cemented casing and/or liner completion, a gravel-packed completion, etc.) As shown in FIG. 1, completions 42, 44, 46, 50, 52 provide fluid communication between injection well 32, hydrocarbon bearing zones 22, 24, and production wells 30, 34. Production well 34 only connects with upper hydrocarbon bearing zone 22. Chokes or well control devices 54, 56, 60 are used to control the flow of fluid into and out of respective production wells 30, 34 and injection well 32. Well control devices 54, 56, 60 also control the pressure profiles in production wells 30, 34 and injection well 32. Although not shown, production wells 30, 34 and injection well 32 fluidly connect with surface facilities (e.g., oil/gas/water separators, gas compressors, storage tanks, pumps, gauges, pipelines). The rate of flow of fluids through production wells 30, 34 and injection well 32 may be limited by the fluid handling capacities of the surface facilities. Furthermore, while control devices 54, 56, 60 are shown above surface in FIG. 1, control devices can also be positioned downhole to control the flow of fluids injected into or received from each of hydrocarbon bearing zones 22, 24.

The zonal allocation modeling tool can be used to compute contributions from hydrocarbon bearing zones 22, 24 of subterranean reservoir 20, which can then be used to allocate production and injection volumes to subsurface layers of a reservoir (e.g., hydrocarbon bearing zones 22, 24 of subterranean reservoir 20). Several embodiments of the present invention are discussed below. The appended drawings illustrate only typical embodiments of the present invention and therefore, are not to be considered limiting of its scope and breadth. As will be described, the invention can be implemented in numerous ways, including for example as a method (including a computer-implemented method), a system (including a computer processing system), an apparatus, a computer readable medium, a computer program product, a graphical user interface, a web portal, or a data structure tangibly fixed in a computer readable memory.

Figure 2:
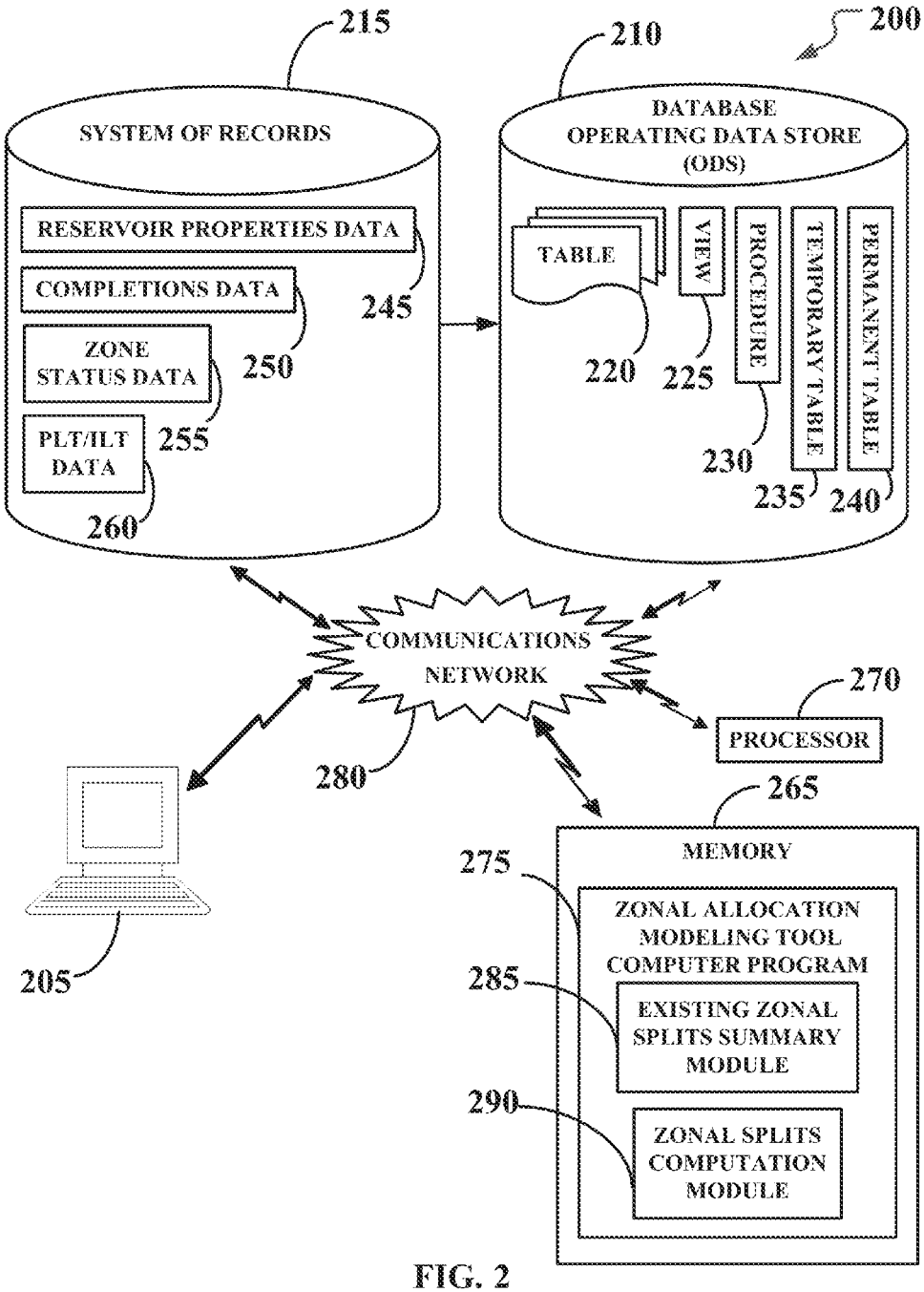
FIG. 2 is a schematic of a zonal allocation modeling tool architecture, and more particular, a block diagram of a computing system that may be used to implement a zonal allocation modeling tool.

FIG. 2 is a schematic of the zonal allocation modeling tool architecture, and more particular, a block diagram of a computing system 200 that may be used to implement a zonal allocation modeling tool. The system 200 includes a user interface 205, such that an engineer/operator can actively input information and review operations of the system 200. The user interface 205 can be any means in which a person is capable of interacting with the system 200 such as a keyboard, mouse, or touch-screen display. Operator-entered data input into the system 200 through the user interface 205 can be stored in at least one database 210 (e.g., a Waterflood Operating Data Store or simply Operating Data Store (ODS)), at least one System of Records 215, or both. The database 210 may include at least one table 220, at least one view 225, at least one procedure 230, at least one temporary table 235, at least one permanent table 240, etc. Additionally, any information generated by system 200 can be stored in the database 210. The database 210 can store user-defined variables, equations and parameters, as well as, reservoir production data, and system 200 generated computed solutions.

Data may also be imported from the System of Records 215 into the database 210. Examples of data that may be stored into the database 210, and imported from the System of Records 215, may include Reservoir Properties Data 245, Completions Data 250, Zone Status Data 255, and PLT/ILT Data 260. Other data may also be stored in database 210 after importation from the System of Records 215. Of note, the System of Records 215 may include the Reservoir Properties Data 245, the Completions Data 250, the Zone Status Data 255, and/or the PLT/ILT Data 260, or alternatively, the System of Records 215 may be communicatively coupled to at least one other system (e.g., OpenWorks® from Landmark and Halliburton, WellView® from Peloton Computer Enterprises Ltd., Petrel® from Schlumberger Limited, Energy Components® from Tieto, Excel® from Microsoft, or others) for receiving the Reservoir Properties Data 245, the Completions Data 250, the Zone Status Data 255, and/or the PLT/ILT Data 260.

Figure 8:
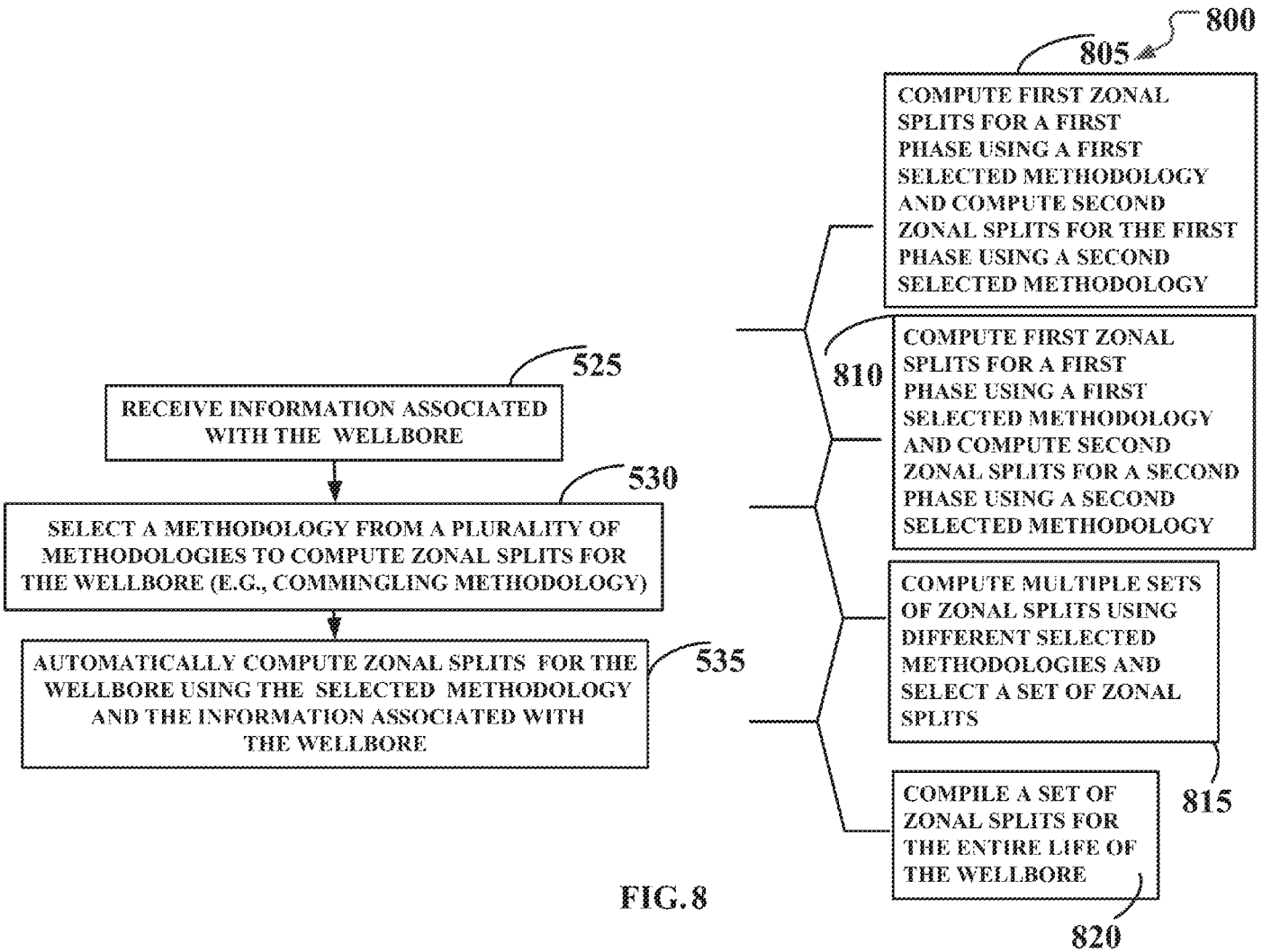
FIG. 8 illustrates a flowchart of a process performed by a computing system for computing zonal splits according to an example embodiment.

The system 200 may include at least one memory 265 and at least one processor 270. The memory 265 and the processor 270 are communicatively connected via at least one bus (e.g., data bus). The memory 265 can include any of a variety of memory devices, such as using various types of computer-readable, computer-recordable, or computer storage media that may be any medium that can contain or store a computer program (e.g., simply program, program code) for use by or in connection with the processor 270, an instruction execution system, apparatus, or device. In the embodiment shown, the memory 265 may store a zonal allocation modeling tool computer program 275. The computer program 275 can include a plurality of modules for performing system tasks such as performing the processes described herein, including the processes shown in FIGS. 3,5,8. Examples of modules of the computer program 275 include, but are not limited to, an Existing Zonal Splits Summary Module 285 and a Zonal Splits Computation Module 290.

The processor 270 interprets instructions to execute the computer program 275, as well as, generates automatic instructions to execute the computer program 275 for the system 200 responsive to predetermined conditions. Instructions from both the user interface 205 and the computer program 275 are processed by the processor 270 for operation of the system 200. In some embodiments, a plurality of processors 270 can be utilized such that system operations can be executed more rapidly.

In some embodiments, the computer program 275 is in communication (such as over at least one communications network 280) with other devices configured to perform the processes described herein. In some embodiments, a software program may be executable on a computer processer, and the software program or the computer readable instruction may include a zonal split generator that automatically computes zonal splits for a wellbore using a selected methodology and information associated with the wellbore that is in fluid communication with producing zones of the multi-layered subterranean reservoir.

Embodiments of the present disclosure may also be implemented as a computer process (method), a computing system, or as an article of manufacture, such as a computer program product or computer readable media or computer recordable media. The computer program product may be a computer storage media readable by a computer system and encoding a computer program of instructions for executing a computer process. For example, the computer program product may include the computer program 275 or software stored on a non-transitory processor readable medium. Current examples of a processor readable medium include, but are not limited to, an electronic circuit, a semiconductor memory device, a ROM, a flash memory, an erasable programmable ROM (EPROM), a floppy diskette, a compact disk (CD-ROM), an optical disk, a hard disk, and a fiber optic medium. Accordingly, embodiments of the present disclosure may be embodied in hardware and/or in software (including firmware, resident software, micro-code, etc.).

In certain embodiments, the system 200 can also include a reporting unit to provide information to the user or to other systems (not shown). For example, the reporting unit can be a printer, display screen, or a data storage device. However, it should be understood that the system 200 need not include a reporting unit, and alternatively the user interface 205 can be utilized for reporting information to the user.

Communication between any components of the system 200, such as the user interface 205, the database 210, the System of Records 215, the computer program 275, the processor 270, and any reporting units can be transferred over the communications network 280. The communications network 280 can be any means that allows for information transfer. Examples of the communications network 280 presently include, but are not limited to, a switch within a computer, a personal area network (PAN), a local area network (LAN), a wide area network (WAN), and a global area network (GAN). The communications network 280 can also include any hardware technology used to connect the individual devices in the network 280, such as an optical cable or wireless radio frequency.

In operation, a user, such as an operator or engineer, initiates the zonal allocation modeling tool computer program 275, through the user interface 205, to perform the processes described herein. The processor 270 may execute the zonal allocation modeling tool computer program 275 to obtain (e.g., by pulling, requesting and receiving, or simply receiving, depending on the particular implementation) input out of the Systems of Records 215 (e.g., OpenWorks, WellView, Petrel, EnergyComponents, Microsoft Excel) and the input may be stored in the database 210 (e.g., ODS). The Zonal Splits Computation Module 290 may utilize the input received from the database 210 to provide the library of methodologies to compute zonal splits and allow for user-defined methodologies to compute zonal splits. In particular, the tool may host a library of zonal split equations, such as the equations presented in the below table, or users can create their own equations and/or modify the equations presented in the below table. The Zonal Splits Computation Module 290 may also utilize the input received from the database 210 to automatically compute zonal splits for each layer or zone of a particular well using the input (e.g., for a set date or a range of dates, or can create a historical collection of zonal splits). The zonal splits may be computed at the perforation level.

The below table provides examples of inputs (data collected/provided) and associated calculation methods utilized for computing (or generating) zonal splits:

| # | Inputs | Calculation Method |
|---|---|---|
| 1 | PLT/ILT<br>Reservoir properties<br>Density Logs<br>Neuron Logs<br>Perforation History | K*H/sum(K*H)<br>Different variations of H depending on cutoffs<br>PLT/ILT |
| 2 | PLT/ILT<br>Saturation Logs<br>Fluid Properties<br>Reservoir Properties<br>Perforation History | (K*H)*Kro/sum(K*H)*Kro<br>(K*H)*Krw/sum(K*H)*Krw<br>A complex calculation that uses saturation logs data to estimate splits using algorithm from when 1 zone was open<br>PLT/ILT |
| 3 | PLT/ILT<br>Reservoir Properties<br>Pressure Data (RFT or estimated)<br>Perforation History | (Phi*H)/sum(Phi*H)<br>Phi *H * $(1 - S_w)$ * $(P_i - P_f)$/ sum(Phi *H * $(1 - S_w)$ * $(P_i - P_f)$)<br>Separate algorithm for commingled reservoirs<br>PLT/ILT |

Furthermore, in operation, the Existing Zonal Splits Summary Module 285 may be configured to utilize the input received from the database 210 to provide existing zonal splits for a particular well or wellbore, including zonal splits previously used for zonal allocation, zonal splits that were computed (via the Zonal Splits Computation Module 290) but have not been ported for zonal allocation, or a combination thereof. Outputs from the zonal allocation modeling tool computer program 275 can be stored in the database 210. Additionally, a visual display can be produced, such as through a reporting unit or the user interface 205 via the Existing Zonal Splits Summary Module 285. For example, the output can be transformed into image data representations for display to a user or operator. The displayed information can be utilized to forecast or optimize the production performance of a subterranean reservoir, such as the subterranean reservoir 20 of FIG. 1, which can then be used for reservoir management decisions.

The computation of zonal splits can be implemented in the general context of instructions executed by a computer. Such computer-executable instructions may include programs, routines, objects, components, data structures, and computer software technologies that can be used to perform particular tasks and process abstract data types. Software implementations of the disclosed processes may be coded in different languages for application in a variety of computing platforms and environments. It will be appreciated that the scope and underlying principles of the disclosed embodiments are not limited to any particular computer software technology.

Moreover, those skilled in the art will appreciate that the disclosed embodiments may be practiced using any one or a combination of computer processing system configurations, including, but not limited to, single and multi-processer systems, hand-held devices, programmable consumer electronics, mini-computers, or mainframe computers. The disclosed embodiments may also be practiced in distributed computing environments where tasks are performed by servers or other processing devices that are linked through a one or more data communications networks. In a distributed computing environment, program modules may be located in both local and remote computer storage media including memory storage devices.

Also, as indicated hereinabove, an article of manufacture for use with a computer processor, such as a CD, prerecorded disk or other equivalent devices, could include a computer program storage medium and program means recorded thereon for directing the computer processor to facilitate the implementation and practice of the disclosed embodiments. Such devices and articles of manufacture also fall within the spirit and scope of the present invention.

Figure 3:
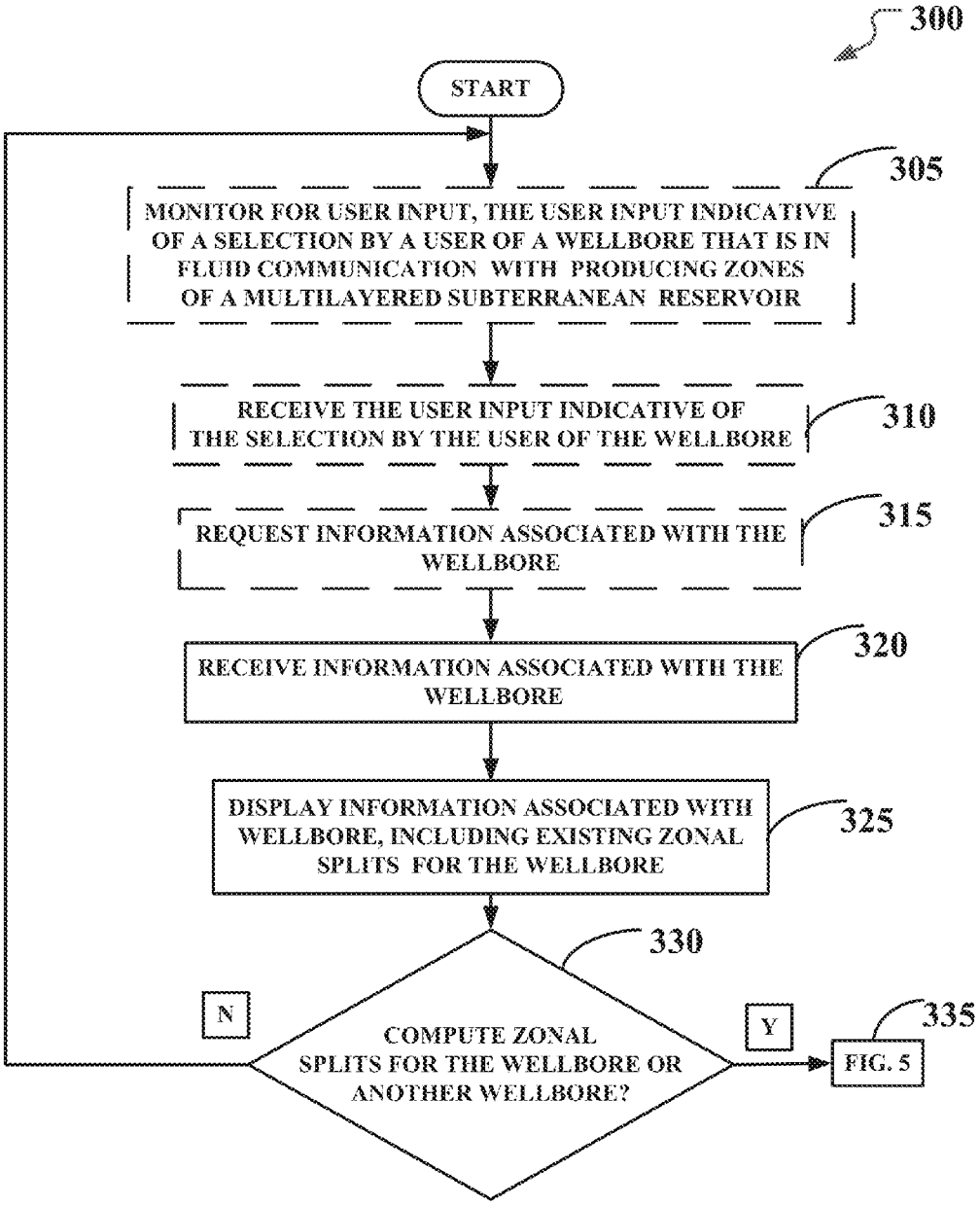
FIG. 3 illustrates a flowchart of a process performed by a computing system for retrieving and visualizing existing zonal splits according to an example embodiment.

Referring now to FIG. 3, a flowchart of a process 300 performed by a computing system for retrieving (or receiving) and visualizing existing zonal splits is shown according to an example embodiment. The process 300 can be performed, for example, by the computing system 200 and the zonal allocation modeling tool computer program 275, including the Existing Zonal Splits Summary Module 285, of FIG. 2.

In some embodiments, the process 300 may be responsive to user input. A multilayered subterranean reservoir may have a large plurality of wells or wellbores, and each of the wellbores may be operating for a long period of time (e.g., multiple decades). A user may want to study existing zonal splits for a particular wellbore of the multilayered subterranean reservoir. As such, after the process 300 begins, at 305, the process 300 may monitor for user input that is indicative of a selection by a user of a wellbore that is in fluid communication with producing zones of a multilayered subterranean reservoir.

At 310, the process 300 may receive the user input indicative of the selection by the user of the wellbore. For example, the user input may be received at 310 via a prompt, a pull down menu, etc.

At 315, the process 300 may request information associated with the wellbore. For example, the process 300 may request information from the database 210 of FIG. 2 for the wellbore selected by the user in response to receiving the user input at 310. Data from the System of Records 215 of FIG. 2 may be imported into the database 210 to generate a response to the request for information from the database 210. Of note, in some embodiments, 305, 310, and/or 315 may be optional. Thus, these are illustrated in dashed boxes to indicate that they may be optional.

At 320, the process 300 may receive information associated with the wellbore. For example, information may be received for each zone of the wellbore. In particular, information may include, but is not limited to, well code, reservoir code, zone code, existing zonal splits (including at the reservoir level), submission status of the existing zonal splits, selected methodology or methodologies used to compute the existing zonal splits, comments, other data, etc. The existing zonal splits may include zonal splits previously used for zonal allocation, zonal splits that were computed (e.g., via the Zonal Splits Computation Module 290 of FIG. 2) but have not been ported for zonal allocation, or a combination thereof.

At 325, the process 300 may display the information associated with the wellbore. For example, display representations of the information associated with each zone of the wellbore received at 320 may be displayed to the user. In particular, the existing zonal splits for the wellbore may be displayed to the user.

As an example, FIGS. 4A-4B show an example screenshot 400 of a zonal allocation modeling tool used for visualizing existing zonal splits. The zonal allocation modeling tool may also be used for computing zonal splits, which can be used in modeling zonal allocation in multilayered subterranean reservoirs. Per FIGS. 4A-4B, the zonal allocation modeling tool may include a user interface where an operator can navigate between a summary of existing zonal splits (via the Existing Zonal Splits Summary Module 285 of FIG. 2), as well as generate new zonal splits and/or update existing zonal splits (via the Zonal Splits Computation Module 290 of FIG. 2). The summary of existing zonal splits can include zonal splits previously used for zonal allocation, zonal splits that were created but have not been ported for zonal allocation, or a combination thereof.

As illustrated in FIG. 4A, the information that may be received and displayed for a wellbore and each zone thereof may include, but is not limited to, well code 405, reservoir code 410, zone code 415, and existing zonal splits, including existing zonal splits at the reservoir level. FIG. 4A illustrates zone factors (i.e., existing zonal splits from a System of Records in a column 435, such as the System of Records 215 of FIG. 2) and reservoir factors (i.e., existing zonal splits at a reservoir level from a System of Records in a column 425, such as the System of Records 215 of FIG. 2) used previously for zonal allocation. FIG. 4A also illustrates recently computed or new zone factors (i.e., existing zonal splits from a database in a column 430, such as the database 210 of FIG. 2) and recently computed reservoir factors (i.e., existing zonal splits at a reservoir level from a database in a column 420, such as the database 210 of FIG. 2).

The total value of the existing zonal splits at the reservoir level from the database 210 in the column 420 should be the summation of the corresponding existing zonal splits from the database 210 in the column 430. The total value should be 1.0 in this example, and it is 1.0. The value of the existing zonal splits at the reservoir level from the database 210 in the column 425 should be the summation of the corresponding existing zonal splits from the database 210 in the column 435, and also should be 1.0 in this example. The various factors may be provided to facilitate approvals of existing zonal splits in the database 210, for example, through comparisons between existing zonal splits from the database 210 in the column 430 pending approval and the existing zonal splits from the System of Records 215 in the column 435 that have already been approved.

It is worth noting that zonal split information may be provided for various phases, namely, a gas phase, an oil phase, and a water phase. For example, the existing zonal splits from database 210 illustrate existing zonal splits for the gas phase in column 440, existing zonal splits for the oil phase in column 445, and existing zonal splits for the water phase in column 450. The zonal splits for the gas phase, the oil phase, and the water phase in columns 440, 445, and 450, respectively, may be considered a set of zonal splits.

Turning to FIG. 4B, the information that may be received and displayed for the wellbore and each zone thereof may further include a submission status 455 (e.g., of the existing zonal splits from database 430 pending approval) and a selected methodology 460 used for computing the existing zonal splits. Furthermore, the existing zonal splits, with any associated user comments 465, the effective date of the existing zonal splits 470, and other data 475 (e.g., audit information such as who created/updated each zonal split and when they were created/updated) may also be provided.

As illustrated in the screenshot 400 of FIGS. 4A-4B, a user selected wellbore WELL-A, and information for each zone of WELL-A was provided. For example, on effective date Jul. 20, 2009, there were two items, namely, ZONE-A and ZONE-B. The user can see that ZONE-B was closed as the existing zonal splits have a value of 0.00 for each of the phases in each of the columns 440, 445, and 450. On the other hand, ZONE-A was open as the existing zonal splits have a value of 1.00 for each of the phases in each of the columns 440, 445, and 450. The existing zonal splits have been submitted for approval, as illustrated in the submission status 455, and the selected methodology 460 used to compute these existing zonal splits was PHI*H SPLIT.

On effective date Jun. 6, 2009, there were eleven items, namely, ZONE-C, ZONE-A, ZONE-D, ZONE-E, ZONE-F, ZONE-G, ZONE-H, ZONE-I, ZONE-J, ZONE-K, AND ZONE-L. A user can see that ZONE-D, ZONE-E, ZONE-F, AND ZONE-J were closed as the existing zonal splits have a value of 0.00 for each of the phases in each of the columns 440, 445, and 450 for these zones. On the other hand, ZONE-C, ZONE-A, ZONE-G, ZONE-H, ZONE-I, ZONE-K, and ZONE-L were open as the existing zonal splits have a value greater than 0.00 for each of the phases in each of the columns 440, 445, and 450. The existing zonal splits have been submitted for approval, as illustrated in the submission status 455, and the selected methodology 460 used to compute these existing zonal splits was PHI*H SPLIT.

If existing zonal splits for these effective dates were in the System of Records 215 of FIG. 2, for example, then those existing zonal splits may be illustrated in the columns 425, 435. Those of ordinary skill in the art may appreciate that the screenshot 400 of FIGS. 4A-4B provides significant amount of information to users and may be a starting point for practically any analysis.

Referring back to FIG. 3, the process 300 determines whether to compute zonal splits for the wellbore or another wellbore at 330. For example, after the user examines the screenshot 400 of FIGS. 4A-4B, the user may click on a compute zonal splits button 480 in FIG. 4A or otherwise cause initiation of the Zonal Splits Computation Module 290. In response to this user input, the process 300 may initiate a process 500 of FIG. 5 to compute zonal splits (e.g., new zonal splits). Zonal splits may be computed by the process 500 for the wellbore or another wellbore. If no user input is received by the process 300, the process 300 may continue to monitor for user input at 305.

Figure 5:
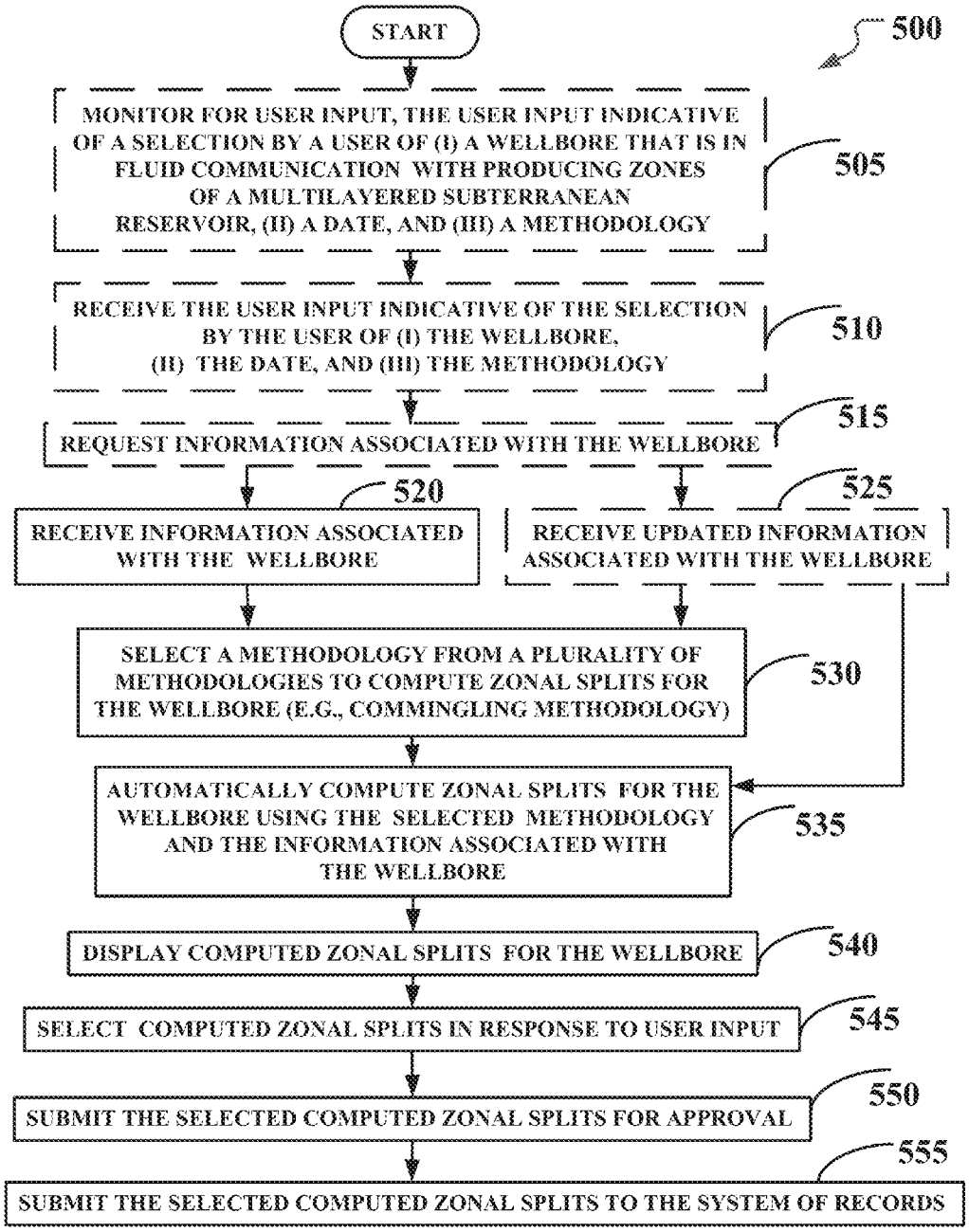
FIG. 5 illustrates a flowchart of a process performed by a computing system for computing zonal splits according to an example embodiment.

Turning to FIG. 5, a flowchart of a process 500 performed by a computing system for computing zonal splits is shown according to an example embodiment. The process 500 can be performed, for example, by the computing system 200 and the zonal allocation modeling tool computer program 275, including the Zonal Splits Computation Module 290, of FIG. 2.

At 505, the process 500 may monitor for user input that is indicative of a selection by a user of a wellbore that is in fluid communication with producing zones of a multilayered subterranean reservoir. The process 500 may also monitor for user input indicative of a selection of a date and a methodology. At 510, the process 500 may receive the user input indicative of the selection by the user of the wellbore, the date, and the methodology. For example, the user input indicative of the wellbore, the date, and the methodology selected by the user may be received at 510 via a prompt, a pull down menu, etc.

As another example, the user may select these items via a select well button 605, a select date button 610, and a select methodology button 615 as illustrated in a screenshot 600 in FIGS. 6A-6B. FIGS. 6A-6B illustrate an example screenshot 600 of a zonal allocation modeling tool used for computing zonal splits, which can be used in modeling zonal allocation in multilayered subterranean reservoirs. Per FIGS. 6A-6B, the zonal allocation modeling tool may include a user interface where an operator can request generation of new zonal splits and/or update existing zonal splits (via the Zonal Splits Computation Module 290 of FIG. 2).

Figure 7C:
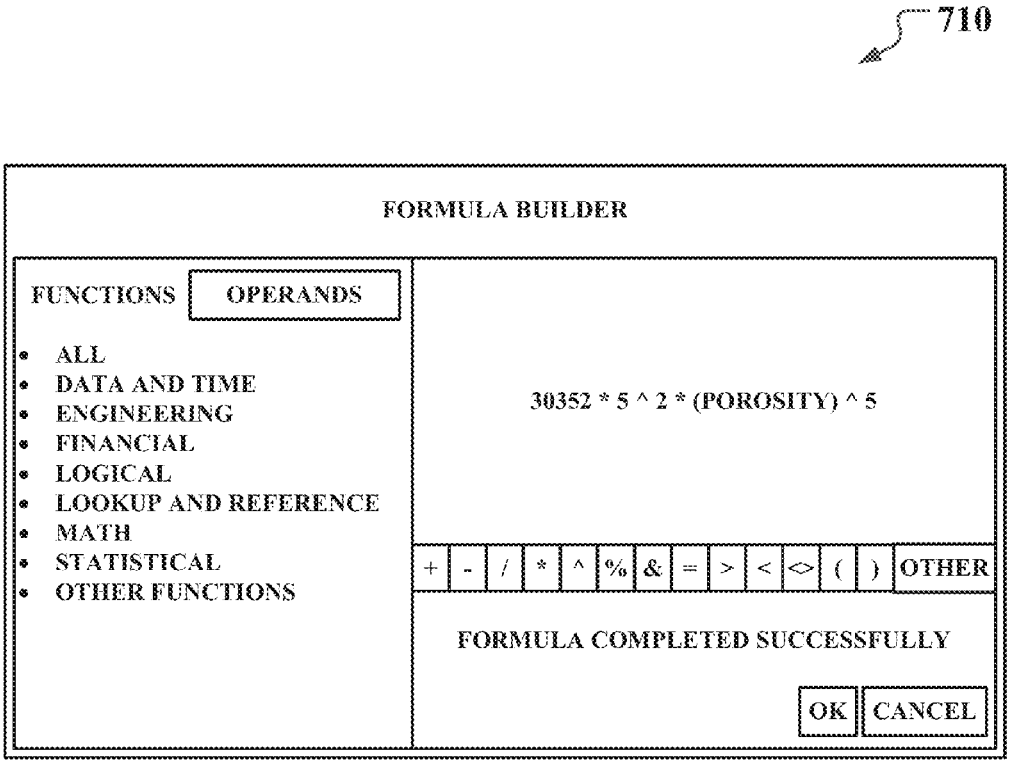
FIG. 7C illustrates an exemplary formula builder for creating methodologies for computing zonal splits.

Of note, prior to monitoring for the user input, the process 500 may provide the user with a library of methodologies to compute the zonal splits, and the user may select the methodology from this library. For example, the library of methodologies may include at least one commingling methodology 700 as illustrated in FIG. 7A, as well as other methodologies 705 as illustrated in FIG. 7B. The methodologies may include formulas. Moreover, a formula builder 710 in FIG. 7C may also be provided to allow the user to extend the library of methodologies and select a methodology generated via the formula builder. Each of these may be accessible to the user, for example, via the select methodology button 615 of FIG. 6A.

One or more of the commingling methodology 700 may be useful for the following reasons. Sometimes the gas in a zone includes another item (e.g., oil or liquid) commingled with the gas, and therefore the gas is not all gas. Similarly, sometimes the oil in a zone includes another item (e.g., gas) commingled within the oil, and therefore the oil is not all oil. The commingling methodology 700 may provide more accurate zonal splits that may account for the commingled items, which may then lead, for example, to more accurate allocation of production volumes.

Referring back to FIG. 5, at 515, the process 500 may request information associated with the wellbore, the date, and/or the methodology selected by the user. For example, the process 500 may request information from the database 210 of FIG. 2 for the wellbore selected by the user in response to receiving the user input at 510. Data from the System of Records 215 of FIG. 2 may be imported into the database 210 to generate a response to the request for information from the database 210. In some embodiments, though, 505, 510, and/or 515 may be optional. Thus, these are illustrated in dashed boxes to indicate that they may be optional.

At 520, the process 500 may receive information associated with the wellbore (the date and/or the methodology). For example, the information may be received for each zone of the wellbore. The information may be inputs to the methodology. In particular, information may include, but is not limited to, well code, reservoir code, zone code, appropriate Reservoir Properties Data 245 from FIG. 2, appropriate Completions Data 250 from FIG. 2, appropriate Zone Status Data 255, and appropriate PLT/ILT Data 260, etc. Indeed, if the wellbore is a production wellbore, then the information associated with the wellbore may comprise production logging tool data. If the wellbore is an injection wellbore, then the information associated with the wellbore may comprise injection logging tool data.

At 530, the process 500 may select a methodology (e.g., from a plurality of methodologies) to compute zonal splits for the wellbore. For example, the methodology selected by the user at 510 may be selected by the process 500 at 530. Thus, the selection at 530 may be responsive to the user input. As will be described hereinbelow in connection with FIG. 8, multiple methodologies may be selected to compute zonal splits (e.g., for what if scenarios).

At 535, the process 500 may automatically compute zonal splits for the wellbore using the selected methodology and the information associated with the wellbore. At 540, the process may display the computed zonal splits for the wellbore. Display representations of the computed zonal splits may be displayed to the user. For example, as illustrated in a column 655 of FIGS. 6A-6B, zonal splits may be automatically computed and displayed for the oil phase of each of ZONE-M, ZONE-N, ZONE-P, and ZONE-Q of WELL-A using the commingling methodology of SPLITCOOIL. The SPLITCOOIL methodology is illustrated in FIG. 7A. Alternatively, as illustrated in column 660 of FIGS. 6A-6B, zonal splits may be automatically computed and displayed for the gas phase of each of the ZONE-M, ZONE-N, ZONE-P, and ZONE-Q of the WELL-A using the commingling methodology of SPLITCOGAS. The SPLITCOGAS methodology is also illustrated in FIG. 7A. Alternatively, as illustrated in columns 665, 670, 675 of FIGS. 6A-6B, zonal splits may be automatically computed and displayed for each of the gas phase, oil phase, and water phase of each of the ZONE-M, ZONE-N, ZONE-P, and ZONE-Q of the WELL-A using the PHI*H SPLIT methodology. Alternatively, any other methodology may be utilized to compute zonal splits.

At 545, the process 500 may select computed zonal splits in response to user input. For example, the user may decide that no action should be taken in response to viewing the computed zonal splits, or the user may decide that computed zonal splits should be used to allocate production or injection volumes. If the user decides the latter, then the process 500 may detect user input indicative of the computed zonal splits selected by the user. The selected computed zonal splits may be for a single phase only, such as the oil phase in connection with the commingling methodology of SPLITCOOIL, or for multiple phases, such as the gas phase, the oil phase, and the water phase in connection with the PHI*H SPLIT methodology.

At 550, the process 500 may submit the selected computed zonal splits for approval. For example, the process 500 may send the selected computed zonal splits to the database 210. The computed zonal splits may then become existing zonal splits that are pending approval, as discussed in connection with the columns 440, 445, and/or 450 of FIG. 4A.

At 555, the process 500 may submit the selected computed zonal splits to the System of Records. For example, the process 500 may submit directly, or via the database 210, the computed zonal splits to the System of Records 215 of FIG. 2. The submission to the System of Records 215 may be in response to receiving approval at 550. Allocation of production or injection volumes for the producing zones of the multilayered subterranean reservoir may occur at the System of Records 215. For example, vendors, users, software, etc. associated with the System of Records 215 may be responsible for allocation the production or injection volumes based on the selected computed zonal splits received from the process 500.

Those of ordinary skill in the art will appreciate that various modifications may be made to the process 500. For example, referring to 525 of FIG. 5, in some embodiments, the process 500 may receive updated information associated with the wellbore, and as a result, the process 500 may pass to 535 to automatically compute updated zonal splits for the wellbore. Other modifications may include those illustrated in a process 800 of FIG. 8.

Referring to FIGS. 5, 6A, 6B, 8, the process 800 elaborates further on 525, 530, and 535 of the process 500 of FIG. 5. As explained hereinabove, zonal splits may be computed for a single phase (e.g., using the SPLITCOOIL methodology) or for multiple phases (e.g., using the PHI*H SPLIT methodology for each phase). At 805, the process 800 may compute first zonal splits for a first phase using a first selected methodology and compute second zonal splits for the first phase using a second selected methodology. The first selected methodology and the second selected methodology are different. As illustrated in the columns 655 and 665, two different methodologies, SPLITCOOIL and PHI*H SPLIT, respectively, were utilized to compute zonal splits for the oil phase. Moreover, as illustrated in a column 680, a third methodology, KCORR*H SPLIT, was also utilized to compute zonal splits for the oil phase. Similarly, as illustrated in the columns 660 and 670, two different methodologies, SPLITCOGAS and PHI*H SPLIT, respectively, were utilized to compute zonal splits for the gas phase. Moreover, as illustrated in a column 685, a third methodology, KCORR*H SPLIT, was also utilized to compute zonal splits for the gas phase. Similarly, as illustrated in the columns 690 and 675, two different methodologies, KCORR*H SPLIT and PHI*H SPLIT, respectively, were utilized to compute zonal splits for the water phase. Other methodologies, such as PLT or ILT or others, may also be utilized as indicated in a column 695.

At 810, the process 800 may compute first zonal splits for a first phase using a first selected methodology and compute second zonal splits for a second phase using a second selected methodology. The first selected methodology and the second selected methodology are different. The computed zonal splits for the gas phase are different in the columns 685 and 670 because of the two different methodologies, KORR*H SPLIT and PHI*H SPLIT, respectively. In some embodiments, the computed zonal splits in the column 665 may be selected for the oil phase based on the PHI*H methodology (and the computed zonal splits in the column 675 may also be selected for the water phase based on the PHI*H methodology), but the computed zonal splits in the column 685 may be selected for the gas phase based on the KCORR*H SPLIT methodology. Similarly, the computed zonal splits in the column 665 may be selected for the oil phase based on the PHI*H methodology (and the computed zonal splits in the column 675 may be selected for the water phase based on the PHI*H methodology), but the computed zonal splits in the column 660 may be selected for the gas phase based on the SPLITCOGAS methodology.

At 815, the process 800 may compute multiple sets of zonal splits using different selected methodologies and selects a set of computed zonal splits. For example, as illustrated in columns 680, 685, 690, zonal splits may be computed for each of the oil phase, gas phase, and water phase using the KCORR*H SPLIT methodology (i.e., a first set of zonal splits). As illustrated in columns 665, 670, 675, zonal splits may be computed for each of the oil phase, gas phase, and water phase using the PHI*H SPLIT methodology (i.e., a second set of zonal splits). Either the first set or the second set may be selected.

At 820, the process 800 may compile a set of zonal splits for the entire life of the wellbore. For example, as illustrated in FIG. 6A, the user may select a compute historical splits button 601 and the process 800 may compute a set of zonal splits for the entire life of the wellbore. For example, the set of zonal splits for the entire life of the wellbore may be provided via a screenshot 900 in FIG. 9.

Those of ordinary skill in the art will appreciate that the flexibility in methodologies may potentially lead to the selection of more accurate computed zonal splits, and thus, more accurate allocation of volumes. Furthermore, if there is insufficient data for one methodology, for example, the computed zonal splits of a different methodology with more data may be selected.

Those of ordinary skill in the art will appreciate that the process 500 and/or the process 800 may be modified in a variety of different ways before and/or after 805, 810, 815, 820. Furthermore, the zonal splits computed according 805, 810, 815, 820 may be processed as described herein in connection with 540, 545, 550, and/or 555 of FIG. 5.

Those of ordinary skill in the art will also appreciate that various changes (e.g., additions, deletions, changes to the order, etc.) may be made to the embodiments discussed herein without departing from the scope of the present disclosure. For example, users can generate new zonal splits by selecting a "Generate New" module in the zonal allocation modeling tool. Here, a single set of splits can be created based on an effective date set by the user (via a Create Snapshot button) or a historical set of splits through time (based on events that occurred to the well) can be created (via a Generate Historical Splits button). For example, if the user chooses an effective date for the single set of splits and clicks the Create Snapshot button, the tool may generate a grid based on various zonal split calculation methodologies (e.g., calculation based on K*H, calculation based on Phi*H, calculation based on split factors using GOR, CGR, and producing GOR criteria, and/or other disclosed zonal split calculation methodologies or methods) to be used for determining a final set of splits to be used for zonal allocation. The calculation of zonal splits based on PLT data can also be displayed if available. The user can select a preferred method for calculating zonal splits and save it to the database. The user can also filter the data (e.g., filter if a zone having multiple sands between those that are open and those that are closed). Once a new date is created (or an existing date is selected from a drop-down menu) users can investigate splits generated by selected methodology(ies), and the tool may also show available PLT/ILT surveys for the selected well that can be considered as an alternative for splits.

In embodiments, users may be able to customize the zonal allocation modeling tool interface. In particular, users can set up their own display format that includes ordering of columns, which columns are displayed, and label any overarching titles. Additionally, the data coming directly from underlying database 210, which is in a tabular format, can be sorted, filtered, grouped, column ordered, as well as overwritten. This important functionality allows users to proceed with the analysis without the need to go back to one or more of the System of Records 215 in case of missing or invalid data. In one example, variables that are retrieved directly from the database are grouped as user input variables. In another example, variables that are calculated (e.g., results of a database function) are grouped as calculated variables. Both user input variables and calculated variables can be highlighted or color-coded. Users can also highlight or color-code columns with final splits, and display formula(s) used for a column (e.g., by hovering over a column or a right clicking on the column). Calculated variables may be grouped separately and are controlled by a formula builder. They can also be modified either directly in the table or by adjusting the related formula(s).

In embodiments, users can select methodologies for generating splits from an available library of equations, or create their own custom equations and save them for future use. For example, a particular embodiment may store preconfigured methods and options where users can alter the display format. For example, users can select a subset or all available methodologies and display them side-by-side. Users can also select the methodology to be used for a particular well for a particular period of time. For instance, whenever a new set is created, the previous existing set is "end dated" and becomes no longer effective. Furthermore, users can also configure the format of the display grid (i.e., which methodologies to display).

In embodiments, users can enter PLT/ILT data at various levels (e.g., SSD level, depth level, sand level). For example, a PLT/ILT interpretation table can be migrated from the PLT/ILT vendor and stored in local database (e.g., in share-drive, on the web base). Once splits based on PLT are generated, they can be displayed in a grid format for further analysis and subsequently ported to a zonal allocation software or System of Records (e.g., Energy Components or other system).

In embodiments, GOR/CGR can be loaded from the database, or users can enter GOR/CGR data on a well level through the placeholder in the formula builder. Here, the same set of GOR, CGR, and/or Producing GOR will be applied to opened sands in the same well. For example, the calculation engine can retrieve the latest GOR/CGR/Producing GOR combination before the effective date of the split that is being generated. Once splits based on GOR, CGR, and/or Producing GOR data are generated, they can be displayed in a grid format for further analysis and subsequently ported to a zonal allocation software (e.g., Energy Components).

In embodiments, users can extend existing equations or create new equations for cases when standard equations do not apply for generating a set of zonal splits. For example, users can click on a "Builder" button to utilize reservoir characteristics, well completions data, PLT/ILT data, RFT Data, and a number of predefined functions to construct specific calculations. Users can also create new variables. For example, via the zonal allocation modeling tool, a user can add or modify zonal split equations. Here, users can create new zonal split equations including a range of algebraic manipulations. Each zonal split equation can also use variables or other "child" formulas. Users also have an option to save the formula(s) for future reference, or even publish to public domain.

Furthermore, historical set of splits through time based on events that occurred to the well (via the Generate Historical Splits button). Here, the zonal allocation modeling tool moves through the well history (i.e., recognizes changes in perforation history, PLT/ILT tests that were performed on the well, or changes in reservoir/zone properties data) and creates a new set of splits based on that information. In some embodiments, the zonal allocation tool automatically recognizes changes and generates the updated zonal splits. In other embodiments, the user can select which events to honor and which events to discard. The user is also able to select different zonal split generation methods (e.g., calculation based on K*H, calculation based on Phi*H, or other disclosed zonal split calculation methods) to calculate each temporal set of splits. After the user has selected all or a subset of events, the zonal allocation modeling tool automatically generates possible sets of splits for the well through time (i.e., creates the historical set of splits).

An interface to port newly created sets of splits to a System of Records via external zonal allocation software, such as Energy Components (EC)—a hydrocarbon accounting (HCA) software suite for production management in oil and gas distributed by Tieto or other software. For example, after the user creates a new set of splits that is confirmed/approved by the user, the set of splits may be ported to the external zonal allocation software in a synchronous fashion enabling immediate feedback to the user whether insertion of new splits was successful or failed. After the set is inserted into the external zonal allocation software, zonal allocation can be rerun if needed. Rerun of zonal allocation will not affect the production allocation for those wells as those networks can be run separately.

In embodiments, the zonal allocation modeling tool may validate newly generated zonal splits. In one example, plots of historical splits by depth are generated for validation. In another example, a tank model incorporating zonal and areal splits (for pattern waterfloods) is utilized for validation. In another example, CRM is utilized for validation. In some embodiments, multiple tools are utilized as control mechanisms for the user to validate newly generated zonal splits.

As used in this specification and the following claims, the terms "comprise" (as well as forms, derivatives, or variations thereof, such as "comprising" and "comprises") and "include" (as well as forms, derivatives, or variations thereof, such as "including" and "includes") are inclusive (i.e., open-ended) and do not exclude additional elements or steps. Accordingly, these terms are intended to not only cover the recited element(s) or step(s), but may also include other elements or steps not expressly recited. Furthermore, as used herein, the use of the terms "a" or "an" when used in conjunction with an element may mean "one," but it is also consistent with the meaning of "one or more," "at least one," and "one or more than one." Therefore, an element preceded by "a" or "an" does not, without more constraints, preclude the existence of additional identical elements.

The use of the term "about" applies to all numeric values, whether or not explicitly indicated. This term generally refers to a range of numbers that one of ordinary skill in the art would consider as a reasonable amount of deviation to the recited numeric values (i.e., having the equivalent function or result). For example, this term can be construed as including a deviation of ±10 percent of the given numeric value provided such a deviation does not alter the end function or result of the value. Therefore, a value of about 1% can be construed to be a range from 0.9% to 1.1%.

While in the foregoing specification this invention has been described in relation to certain preferred embodiments thereof, and many details have been set forth for the purpose of illustration, it will be apparent to those skilled in the art that the invention is susceptible to alteration and that certain other details described herein can vary considerably without departing from the basic principles of the invention. For example, while embodiments described herein refer to production, one skilled in the art will recognize that they also can be applied to injection. Additionally, while embodiments of the present disclosure are described with reference to operational illustrations of methods and systems, the functions/acts described in the figures may occur out of the order (i.e., two acts shown in succession may in fact be executed substantially concurrently or executed in the reverse order).

What is claimed is:

1. A method for use in modeling zonal allocation in multilayered subterranean reservoirs, the method comprising:

receiving information associated with a wellbore that is in fluid communication with producing zones of a multilayered subterranean reservoir;

selecting a methodology to compute zonal splits for the wellbore, wherein the selected methodology is a commingling methodology, and wherein the commingling methodology is:

SplitCoOil=if(sum(Phi_*h*_*F*oil)=0,0,Phi_*h*_*F*oil/sum(Phi_*h*_*F*oil)*(1−FractionCond))+if(sum(Phi_*h*_*F*Gas)=0,0,Phi_*h*_*F*Gas/sum(Phi_*h*_*F*Gas)*FractionCond) a)

*F*Oil=if(NetPayOil>0,1,0); b)

*F*Gas=if(NetPayGas>0,1,0); c)

GOR=600; d)

CGRInv=20000; e)

ProducingGOR=1000; f)

Phi_*h*_*F*Oil=NetPayOil*Phi**F*Oil; g)

Phi_*h*_*F*Gas=NetPayGas*Phi**F*Gas; h)

and

FractionCond=IF(sum(Phi_*h*_*F*oil)=0,1,IF((ProducingGOR<GOR)|(Sum(Phi_*h*_*F*Gas)=0),0,IF((ProducingGOR>CGRInv),1,((ProducingGOR−GOR)/CGRInv)/(1−(GOR/CGRInv)))))

or

SplitCoGas=if(sum(Phi_*h*_*F*Gas)=0,0,Phi_*h*_*F*Gas/sum(Phi_*h*_*F*Gas)*(1−FractionSolGas))+if(sum(Phi_*h*_*F*Oil)=0,0,Phi_*h*_*F*Oil/sum(Phi_*h*_*F*Oil)*FractionSolGas); a)

*F*Oil=if(NetPayOil>0,1,0); b)

*F*Gas=if(NetPayGas>0,1,0); c)

GOR=600; d)

CGRInv=20000; e)

ProducingGOR=1000; f)

Phi_*h*_*F*Oil=NetPayOil*Phi**F*Oil; g)

Phi_*h*_*F*Gas=NetPayGas*Phi**F*Gas; h)

and

FractionSolGas=IF(sum(Phi_*h*_*F*Gas)=0,1,if ((ProducingGOR>CGRInv)(sum(Phi_*h*_*F*Oil)=0),0,IF(ProducingGOR<GOR,1,(1/ProducingGOR)−(1/CGRInv))*(GOR/(1−(GOR/CGRInv))))); j)

automatically computing zonal splits for the wellbore using the selected methodology and the information associated with the wellbore; and controlling flow of fluids injected into or received from at least one of the producing zones based on the computed zonal splits.

2. The method of claim 1, wherein the wellbore is a production wellbore and the information associated with the wellbore comprises production logging tool data.

3. The method of claim 1, wherein the wellbore is an injection wellbore and the information associated with the wellbore comprises injection logging tool data.

4. The method of claim 1, wherein the automatically computed zonal splits are used to allocate production or injection volumes for the producing zones of the multilayered subterranean reservoir.

5. The method of claim 1, wherein automatically computing zonal splits for the wellbore further comprises compiling a set of zonal splits for the entire life of the wellbore.

6. The method of claim 1, further comprising receiving updated information associated with the wellbore and automatically computing updated zonal splits for the wellbore.

7. The method of claim 1, wherein multiple sets of zonal splits are computed using different selected methodologies and a set of zonal splits is selected to allocate production or injection volumes for the producing zones of the multilayered subterranean reservoir.

8. The method of claim 1, wherein automatically computing zonal splits for the wellbore further comprises computing first zonal splits for a first phase using a first selected methodology and computing second zonal splits for the first phase using a second selected methodology.

9. The method of claim 1, wherein automatically computing zonal splits for the wellbore further comprises computing first zonal splits for a first phase using a first selected methodology and computing second zonal splits for a second phase using a second selected methodology.

10. A system for use in modeling zonal allocation in multilayered subterranean reservoirs, the system comprising:

a database configured to store data comprising information associated with a wellbore that is in fluid communication with producing zones of a multilayered subterranean reservoir;

a computer processor configured to receive the stored data from the database, and to execute software responsive to the stored data; and a software program executable on the computer processor, the software program comprising a zonal split generator that automatically computes zonal splits for a wellbore using a selected methodology and the information associated with the wellbore that is in fluid communication with producing zones of the multilayered subterranean reservoir, wherein the selected methodology is a commingling methodology, and wherein the commingling methodology is:

SplitCoOil=if(sum(Phi_*h*_Foil)=0,0,Phi_*h*_Foil/sum(Phi_*h*_Foil)*(1−FractionCond))+if(sum(Phi_*h*_*F*Gas)=0,0,Phi_*h*_*F*Gas/sum(Phi_*h*_*F*Gas)*FractionCond) a)

*F*Oil=if(NetPavOil>0,1,0); b)

*F*Gas=if(NetPavGas>0,1,0); c)

GOR=600; d)

CGRInv=20000; e)

ProducingGQR=1000; f)

Phi_*h*_*F*Oil=NetPavOil*Phi**F*Oil; g)

Phi_*h*_*F*Gas=NetPavGas*Phi**F*Gas; h)

and

FractionCond=IF(sum(Phi_*h*_Foil)=0,1,IF ((ProducingGOR<GOR|(Sum(Phi_*h*_*F*Gas)=0),0,IF((ProducingGOR>CGRInv),1,((ProducingGOR−GOR)/CGRInv)/(1−(GOR/CGRInv))))) i)

or

SplitCoGas=if(sum(Phi_*h*_*F*Gas)=0,0,Phi_*h*_*F*Gas/sum(Phi_*h*_*F*Gas)*(1−FractionSolGas))+if(sum(Phi_*h*_*F*Oil)=0,0,Phi_*h*_*F*Oil/sum(Phi_*h*_*F*Oil)*FractionSolGas); a)

*F*Oil=if(NetPavOil>0,1,0); b)

*F*Gas=if(NetPayGas>0,1,0); c)

GOR=600; d)

CGRInv=20000; e)

ProducingGQR=1000; f)

Phi_*h*_*F*Oil=NetPavOil*Phi**F*Oil; g)

Phi_*h*_*F*Gas=NetPavGas*Phi**F*Gas; h)

and

FractionSolGas=IF(sum(Phi_*h*_*F*Gas)=0,1,if ((ProducingGOR>CGRInv)|(sum(Phi_*h*_*F*Oil)=0),0,IF(ProducingGOR<GOR,1,(1Producing GOR)−(1/CGRInv))*(GOR/(1−(GOR?CGRInv))))); i)

and a control device that controls flow of fluids injected into or received from at least one of the producing zones based on the computed zonal splits.

11. The system of claim 10, wherein the wellbore is a production wellbore and the information associated with the wellbore comprises production logging tool data.

12. The system of claim 10, wherein the wellbore is an injection wellbore and the information associated with the wellbore comprises injection logging tool data.

13. The system of claim 10, wherein the automatically computed zonal splits are used to allocate production or injection volumes for the producing zones of the multilayered subterranean reservoir.

14. The system of claim 10, wherein the zonal split generator further compiles a set of zonal splits for the entire life of the wellbore.

15. The system of claim 10, wherein the zonal split generator further receives updated information associated with the wellbore and automatically computes updated zonal splits for the wellbore.

16. The system of claim 10, wherein the zonal split generator further computes multiple sets of zonal splits using different selected methodologies.

17. The system of claim 10, wherein automatically computing zonal splits for the wellbore, the zonal split generator further computes first zonal splits for a first phase using a first selected methodology and computes second zonal splits for the first phase using a second selected methodology.

18. The system of claim 10, wherein automatically computing zonal splits for the wellbore, the zonal split generator further computes first zonal splits for a first phase using a first selected methodology and computes second zonal splits for a second phase using a second selected methodology.

19. A non-transitory processor readable medium containing computer readable instructions for modeling zonal allocation in multilayered subterranean reservoirs, the computer readable instructions executed by a computer processor to perform method steps, comprising:

receiving information associated with a wellbore that is in fluid communication with producing zones of a multilayered subterranean reservoir;

selecting a methodology to compute zonal splits for a wellbore;

automatically computing zonal splits for a wellbore using the selected methodology and the information associated with the wellbore, wherein the selected methodology is a commingling methodology, and wherein the commingling methodology is:

SplitCoOil=if(sum(Phi_*h*_*F*oil)0,0,Phi_*h*_*F*oil/sum(Phi_*h*_*F*oil)*(1−FractionCond))+if(sum(Phi_*h*_*F*Gas)=0,0,Phi_*h*_*F*Gas/sum(Phi_*h*_*F*Gas)*FractionCond) a)

*F*Oil=if(NetPavOil>0,1,0); b)

*F*Gas=if(NetPavGas>0,1,0); c)

GOR=600; d)

CGRInv=20000; e)

ProducingGQR=1000; f)

Phi_*h*_*F*Oil=NetPavOil*Phi**F*Oil; g)

Phi_*h*_*F*Gas=NetPavGas*Phi**F*Gas; h)

and

FractionCond=IF(sum(Phi_*h*_*F*oil)=0,1,IF((ProducingGOR<GOR|(Sum(Phi_*h*_*F*Gas)=0),0,IF((ProducingGOR>CGRInv),1,((Producing-GOR−GOR)/CGRInv)/(1−(GOR/CGRInv))))) i)

or

SplitCoGas=if(sum(Phi_*h*_*F*Gas)=0,0,Phi_*h*_*F*Gas/sum(Phi_*h*_*F*Gas)*(1−FractionSolGas))+if(sum(Phi_*h*_*F*Oil)=0,0,Phi_*h*_*F*Oil/sum(Phi_*h*_*F*Oil)*FractionSolGas); a)

*F*Oil=if(NetPavOil>0,1,0); b)

*F*Gas=if(NetPayGas>0,1,0); c)

GOR=600; d)

CGRInv=20000; e)

ProducingGQR=1000; f)

Phi_*h*_*F*Oil=NetPavOil*Phi**F*Oil; g)

Phi_*h*_*F*Gas=NetPavGas*Phi**F*Gas; h)

and

FractionSolGas=IF(sum(Phi_*h*_*F*Gas)=0,1,if((ProducingGOR>CGRInv)|(sum(Phi_*h*_*F*Oil)=0),0,IF(ProducingGOR<GOR,1,(1Producing GOR)−(1/CGRInv))*(GOR/(1−(GOR?CGRInv))))); i)

and controlling flow of fluids injected into or received from at least one of the producing zones based on the computed zonal splits.

* * * * *